United States Patent [19]

Morrow et al.

[11] 4,033,828

[45] July 5, 1977

[54] COKE OVEN DOOR SEAL

[76] Inventors: William K. Morrow, 3722 Forge; Walter B. Peterman, Jr., 2673 Renshaw, both of Troy, Mich. 48084

[22] Filed: July 6, 1976

[21] Appl. No.: 702,553

[52] U.S. Cl. ..... 202/248; 110/173 R; 202/242

[51] Int. Cl.[2] ..... C10B 25/06

[58] Field of Search ..... 202/242, 248, 269; 110/173

[56] References Cited

UNITED STATES PATENTS

| | | | |
|---|---|---|---|
| 2,236,092 | 3/1941 | Freeman | 202/248 |
| 3,505,174 | 4/1970 | Peterson et al. | 202/248 |
| 3,875,018 | 4/1973 | Calderon | 202/248 |
| 3,952,454 | 4/1976 | Sudo | 202/248 X |
| 3,974,038 | 8/1976 | Tucker | 202/248 |

FOREIGN PATENTS OR APPLICATIONS

| | | | |
|---|---|---|---|
| 906,687 | 3/1954 | Germany | 202/248 |

*Primary Examiner*—Joseph Scovronek
*Assistant Examiner*—Roger F. Phillips
*Attorney, Agent, or Firm*—Reising, Ethington, Barnard, Perry and Brooks

[57] ABSTRACT

A coke oven door seal of the disclosure includes a metallic diaphragm plate of a vertically elongated rectangular shape and metallic seal members mounted on the edge portions of the plate in a manner that permits thermal expansion of the seal members along their lengths with respect to the plate edge portions. Preferably, each seal member has an integral channel shape, and first and second aligned sets of holes in the plate edge portions and the bases of the seal members receive attachment bolts for mounting the seal members with their bases engaged with an inner side of the diaphragm plate. One of the sets of holes is oversized along the length of the seal members to permit the thermal expansion thereof with respect to the plate. Best sealing is achieved when the oversized set of holes is in the seal member bases so that the attachment bolts do not move during seal member expansion. The longer seal members extending along the side edge portions of the diaphragm plate have ends that extend to the upper and lower edge portions of the plate while the shorter seal members extending along the upper and lower edge portions of the plate have ends that terminate in engagement with the sides of the longer seal member ends so as not to interfere with the thermal expansion of the longer seal members.

12 Claims, 8 Drawing Figures

COKE OVEN DOOR SEAL

BACKGROUND OF THE INVENTION

1. Field of the Invention

This invention relates to an improved seal for a vertically elongated rectangular coke oven door.

2. Description of the Prior Art

Coke oven doors have heretofore incorporated seals intended to provide sealing of an associated coke oven door opening with the door in a closed position. These doors are normally elongated in a vertical direction with a length of approximately twenty feet and a width of about two feet. With one type of such a door, an operator driven truck with a door carrying mechanism is utilized to position the door in its closed position prior to firing of the oven for preparation of a batch of coke, and the truck is also utilized to remove the door after the coke firing process has been completed. Upper and lower latch mechanisms are utilized to retain the door in its closed position on the coke oven during the firing. Keepers of the latch mechanisms are mounted on the oven with hook-shaped configurations that open upwardly to receive spring biased latch arms mounted on the door so as to maintain the door in engagement with the oven about the associated door opening. To position the door in its closed position, the operator driven truck carries the door so that latch arms are positioned above the hook-shaped keepers such that subsequent downward sliding of the door locates the latch arms thereof within the confines of the keepers to permit the biasing that engages the door with the oven. During removal, the door is slid upwardly by the truck to release the latch arms from the keepers prior to outward movement of the door that provides access to the door opening for removal of the fired coke.

Certain problems have been encountered in attempting to provide an effective seal for coke oven doors of the above-described type. This sealing is necessary to conform to governmental emissions regulations intended to preserve the quality of the environment. One problem with prior seals designed to provide this sealing is that they tend to "snake" along the edges of the doors in a plane across the door opening due to thermal expansion with respect to the door. Another problem with such seals is that they have not been sufficiently flexible in a direction normal to the plane across the door opening to accommodate for irregularities more than ⅜ of an inch or so in the oven surface about the periphery of the associated door opening. It is difficult to achieve complete sealing with a seal having these problems, and since coke ovens have an internal gas pressure of approximately 3 or 4 psi above atmospheric pressure, the gases and tars, etc. present within the oven can escape to the environment.

SUMMARY OF THE INVENTION

An object of the present invention is to provide an improved seal for a coke oven door in order to achieve good sealing during firing of a coke oven with which the door is utilized.

Another object of the invention is to provide a coke oven door seal that utilized tars, etc. present during firing of a batch of coke to aid in the sealing and which provides an effective seal despite thermal expansion of seal members thereof during the firing.

In carrying out the above objects and other objects, the coke oven door seal includes a vertically elongated metallic diaphragm plate of a rectangular shape and elongated metallic seal members mounted on edge portions of the diaphragm plate. The seal members are mounted on the edge portions of the diaphragm plate in a manner that permits relative movement of the seal members along their lengths with respect to the plate so as to accommodate for thermal expansion. Each seal member is relatively flexible in a direction perpendicular to the plane of the diaphragm plate and includes a plurality of spaced projections as well as a base connecting the projections. Inward and outward positioning of the diaghragm plate edge portions is possible due to the flexible nature of the seal members in order to ensure effective sealing of the seal member projections with an associated coke oven about the periphery of an associated door opening. Coke tars, etc. collect between the seal member projections to aid in the sealing.

Attachment bolts are preferably utilized to mount the seal members on the diaphragm plate edge portions. Aligned first and second sets of holes in the plate edge portions and the seal members receive the attachment bolts to provide the mounting. One of the sets of holes is oversized to permit the seal members to thermally expand and contract along their lengths with respect to the associated plate edge portions. The most effective sealing is achieved when the oversized set of holes is in the seal members such that the attachment bolts remain stationary on the plate.

The seal members preferably have a channel shape including a base engaged with the inner side of the associated diaphragm plate edge portion facing the oven and a pair of integral projections that extend from the base toward the oven to provide sealing engagement about the door opening periphery. Between the projections, the base is provided with the oversized set of holes that permit the seal member thermal expansion along its length. Both the diaphragm plate and the seal members are made from stainless steel to prevent corrosion from occurring. The projections of each seal member project from their base for a lesser distance than the width of the base in cross section.

Each longer seal member extending vertically along one of the sides of the door has opposite ends that extend to the upper and lower edge portions of the plate. The shorter seal members extending along the upper and lower ends of the door have ends that terminate short of the side edge portions of the plate so as to engage the ends of the longer seal members from the side. This arrangement of the seal members permits the longer seal members to thermally expand without interference with the shorter seal members.

Adjusting screws are threadedly supported on the door at spaced locations along the edge portions of the diaphragm plate. These screws include ends that engage the plate edge portions on an outer side thereof facing the environment so that inward and outward movement of the plate edges is provided by screw rotation. The inward and outward plate movement flexes the seal members to ensure effective sealing about the total periphery of the associated door opening.

In one embodiment of the seal, the seal members have open space within their cross sections between the projections that engage the oven. Another embodiment of the seal incorporates high temperature sealing material received by the seal members between their projections.

The objects, features and advantages of the present invention are readily apparent from the following detailed description of the preferred embodiments taken in connection with the accompanying drawings.

DETAILED DESCRIPTION OF THE PREFERRED EMBODIMENTS

Figure 1:
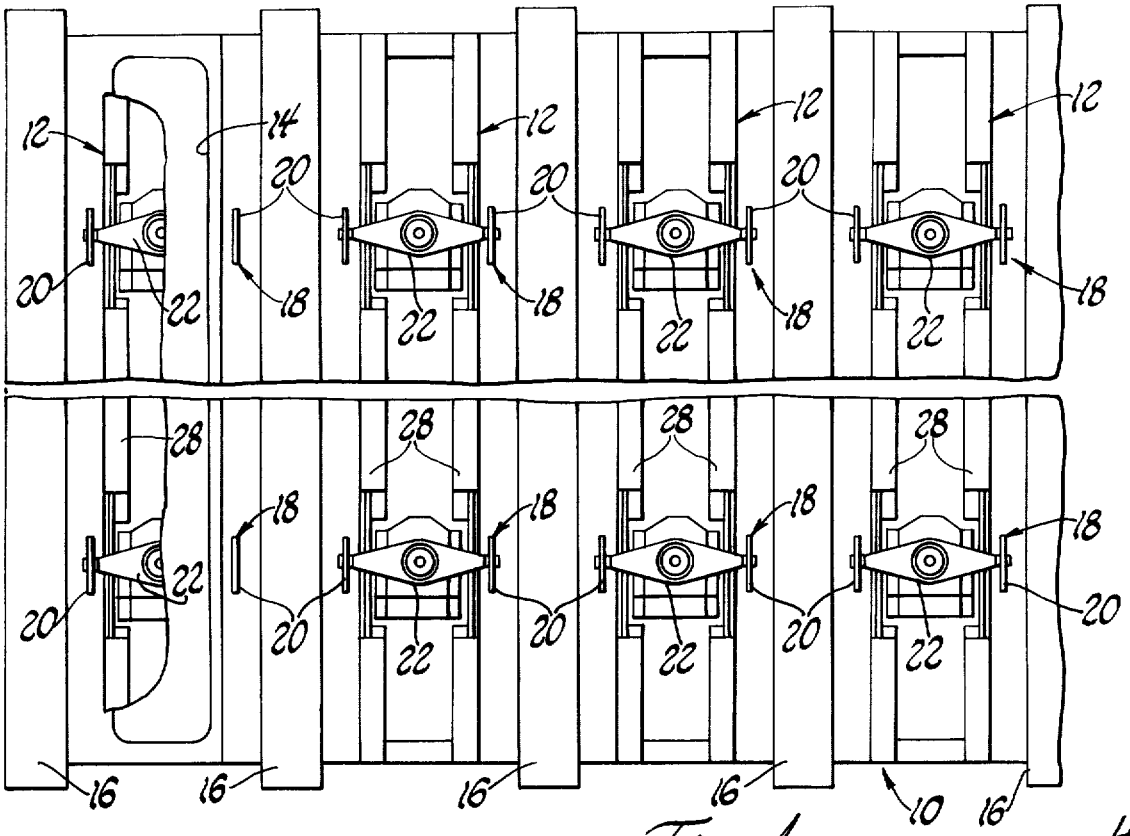
FIG. 1 is a partially broken away elevation view of a coke oven having a bank of doors each of which incorporates a seal constructed according to the present invention.
Figure 3:
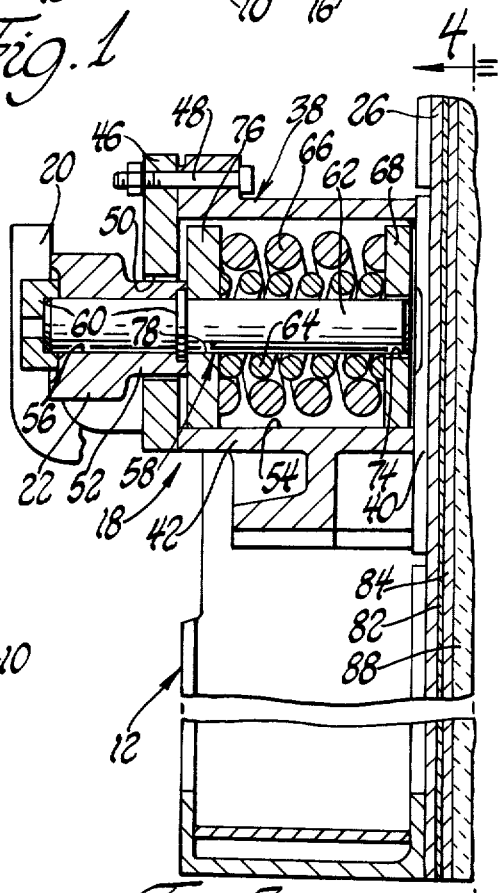
FIG. 3 is a sectional view through the door taken along line 3—3 of FIG. 2 to further illustrate the latch mechanism.

With reference to FIG. 1 of the drawings, a coke oven generally indicated by 10 includes a bank of vertically elongated doors 12 for closing associated door openings 14. Each door opening 14 is elongated in a vertical direction with a rectangular configuration and is located between vertically extending buckstays 16 of the oven support structure. The doors 12 are about two feet wide and have a vertical extent of approximately 20 feet between their upper and lower ends, and there is a lateral distance of approximately 4 feet between the centers of each adjacent pair of buckstays 16. A pair of latch mechanisms 18 are associated with each door 12 adjacent its upper and lower ends in order to position the door in the closed position shown in FIG. 1. Each latch mechanism includes a pair of hook-shaped keepers 20, see also FIG. 3, that open upwardly on opposite sides of the associated door opening. A latch arm 22 of each latch mechanism is mounted on the door and has opposite ends that are positioned over the upwardly opening configurations of the associated keepers when the door is moved toward its closed position by an operator driven truck of the type well known to those familiar with coke ovens. The truck operator then allows the door to slide downwardly so that its latch arms 22 have their opposite ends captured within the confines of the associated keepers 20 to maintain the door in its closed position. Removal of the door 12 to permit a cooked batch of coke to be removed from the oven proceeds by an operator lifting the door upwardly with the truck and then moving the door outwardly so that the door opening 14 is exposed.

Figure 2:
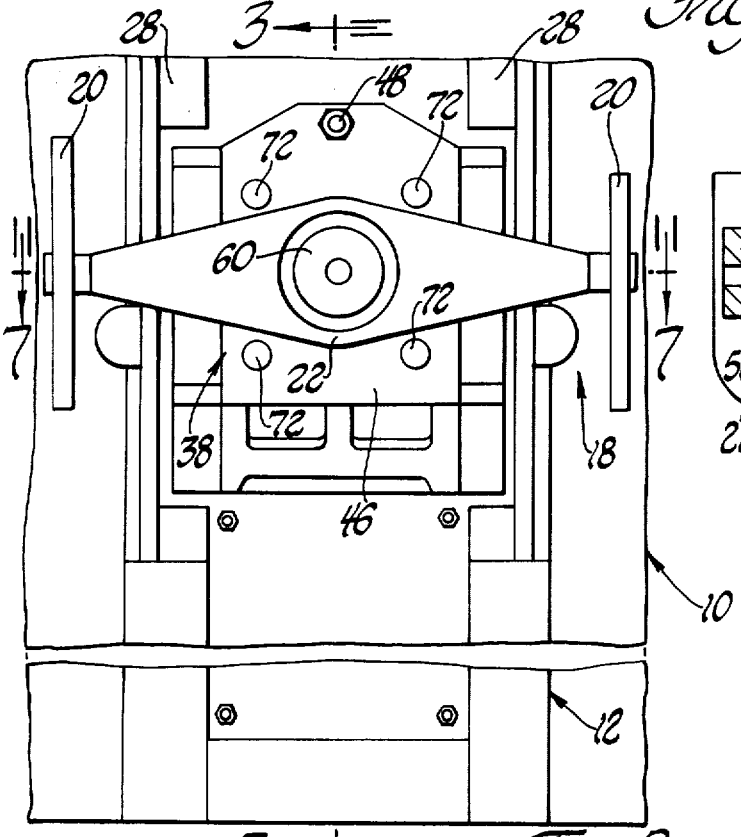
FIG. 2 is an enlarged view of a portion of one of the doors shown in FIG. 1 to illustrate a latch mechanism thereof for holding the door in the closed position shown with respect to the oven.
Figure 7:
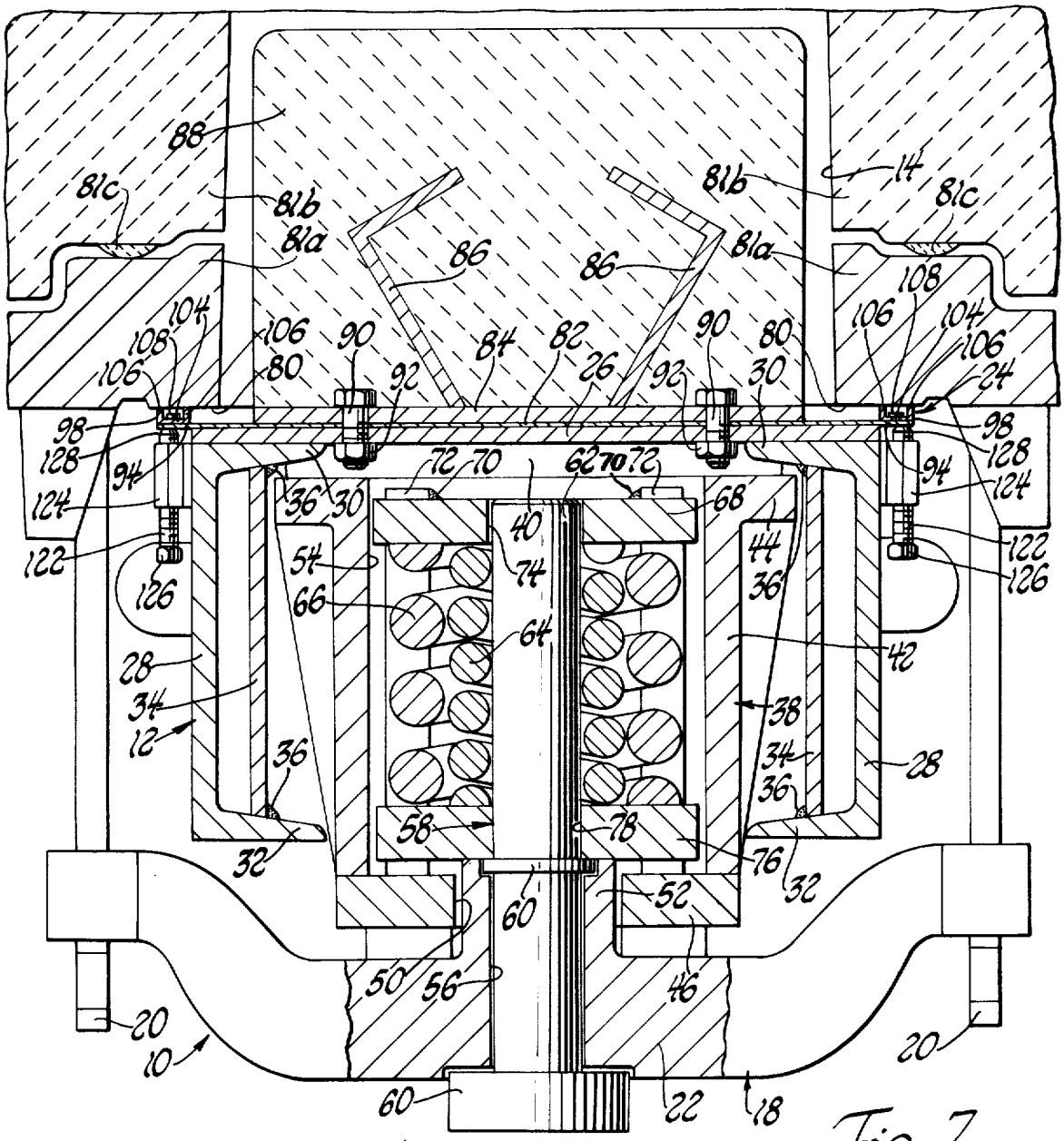
FIG. 7 is a sectional view through the door and the oven taken along line 7—7 of FIG. 2.

With reference to FIG. 7, each door 12 includes a seal 24 constructed according to this invention and mounted on the inner side of a door support plate 26. While prior doors of this type are usually made from cast steel, the door shown is made from a fabricated construction that is stronger than the cast type and less susceptible to warpage upon heating. A pair of channel-shaped beams 28 of the door have inner flanges 30 suitably secured during the fabrication, such as by welding, to the outer side of support plate 26. Beams 28 also include outer flanges 32, and reinforcing plates 34 extend between the inner and outer flanges 30 and 32 so as to be secured thereto by welds 36. A latch housing 38 of latch mechanism 18 is mounted between beams 28 and includes an inner end plate 40 welded to the outer side of support plate 26, a cylindrical portion 42 having an inner flanged end 44 welded to plate 40, and an end cover 46 secured to the outer end of cylindrical portion 42 by a nut and bolt 48 shown in FIGS. 2 and 3. End cover 46 includes a central opening 50, FIGS. 3 and 7, through which an annular central portion 52 of the latch arm 22 extends inwardly into a chamber 54 defined by the cylindrical housing portion 42. An opening 56 within the central latch arm portion 52 receives the outer end of a shaft 58 which includes positioning portions 60 for positioning the shaft axially with respect to the latch arm. An inner end 62 of shaft 58 is encircled by a pair of coaxial helical springs 64 and 66 within the housing chamber 54. The inner ends of springs 64 and 66 are seated against a plate 68 which is secured by welds 70 to the inner ends of rods 72 whose outer ends are fixedly secured to the housing end cover 46. A central aperture 74 of plate 68 receives the extreme inner portion of shaft end 62 and has a sufficient clearance therebetween to permit axial movement of the shaft with respect to this plate. The outer ends of springs 64 and 66 are seated against a plate 76 which defines an opening 78 through which the shaft 58 extends. Springs 64 and 66 bias plate 76 outwardly so that the ends of latch arm 22 are pushed outwardly against the keepers 20 to thereby bias the seal 24 against an oven surface 80 of a cast steel door jam 81*a* defining the periphery of the door opening 14. Door jam 81*a* is secured in position to refractory material 81*b* of the oven in a suitable manner with refractory rope 81*c* maintaining a spaced relationship.

Seal 24 as can be seen in FIG. 7 includes a metallic diaphragm plate 82 preferably of stainless steel sandwiched between the door support plate 26 and a refractory support plate 84. Refractory hooks 86 secured in any suitable manner to the inner side of plate 84 are embedded within a mass of refractory 88 that is received within the furnace door opening 14 with the door in the closed position shown. Heads of bolts 90 are also embedded within the refractory 88 and extend through aligned holes in the door support plate 26, the diaphragm plate 82, and the refractory support plate 84 while being secured by nuts 92 to retain these components in their sandwiched relationship.

Figure 4:
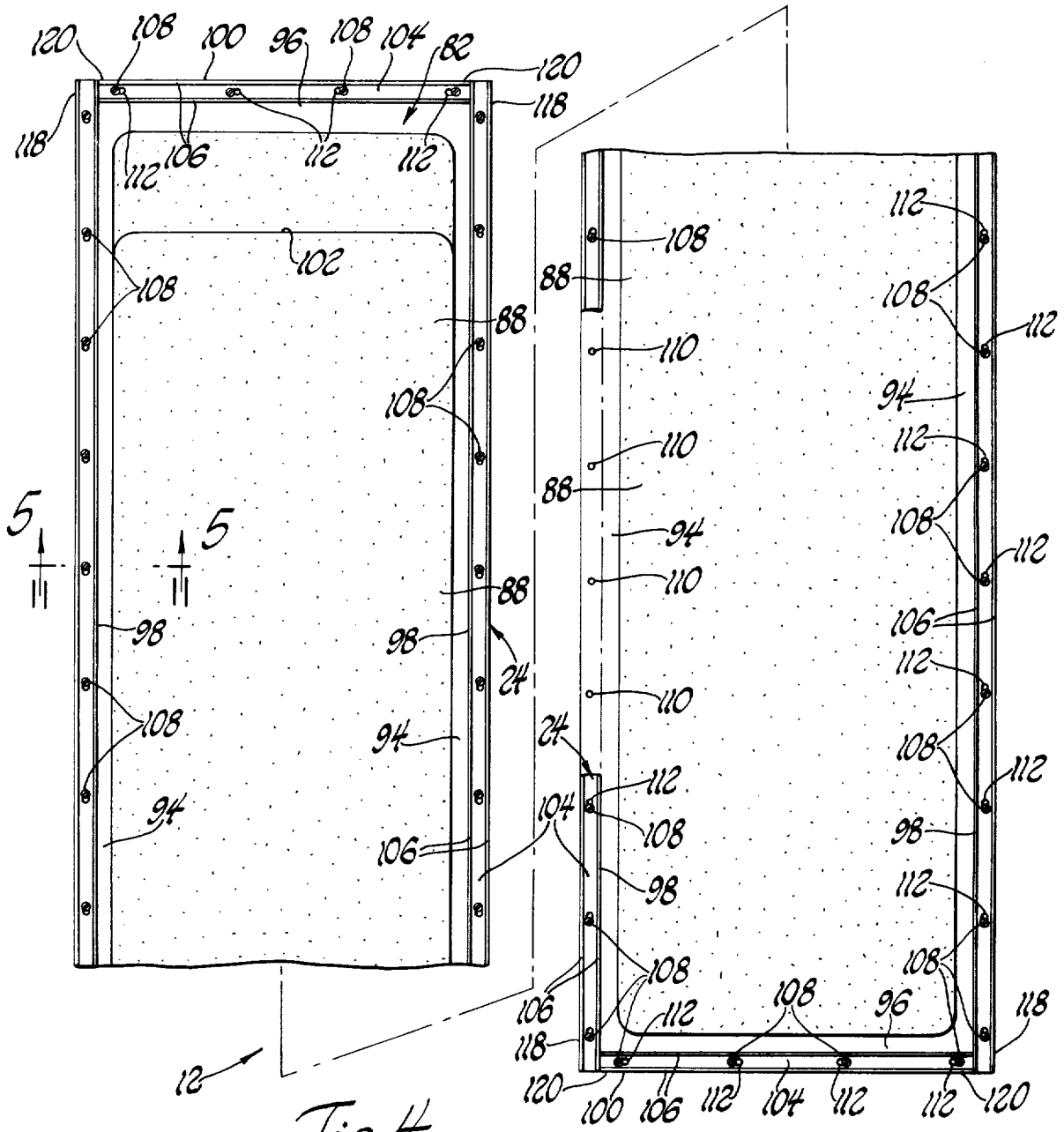
FIG. 4 is a view taken along line 4—4 of FIG. 3 to illustrate the door seal of this invention.

As seen in FIG. 4, diaphragm plate 82 has a vertically elongated rectangular configuration and includes vertical side edge portions 94 at its lateral sides and upper and lower edge portions 96 at its opposite ends. Vertically extending seal members 98 are mounted on the vertical edge portions 94 and have a length which is approximately ten times or so the length of seal members 100 which are mounted on the upper and lower edge portions 96 of the diaphragm plate. The seal members are preferably made from stainless steel like the diaphragm plate 82 so as to prevent corrosion. Adjacent the shorter seal member 100 mounted on the upper edge portion 96 of the plate, the refractory 88 includes a notch 102 that receives the upper extremity of the oven at the upper end of the door opening to permit the refractory to be fully inserted into the door opening prior to its downward sliding movement as the door is moved to its closed position.

Figure 5:
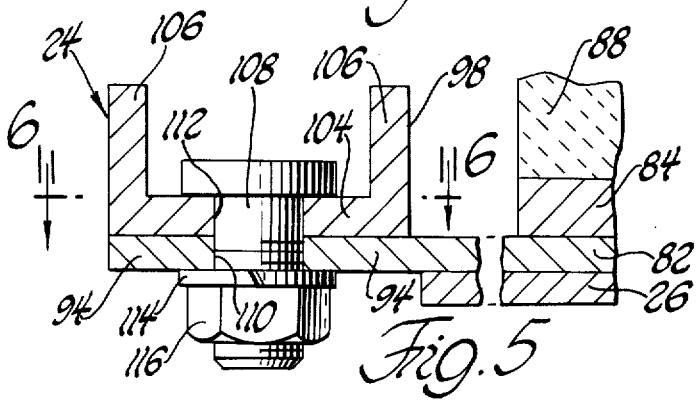
FIG. 5 is a sectional view of the door seal taken along line 5—5 of FIG. 4.
Figure 6:
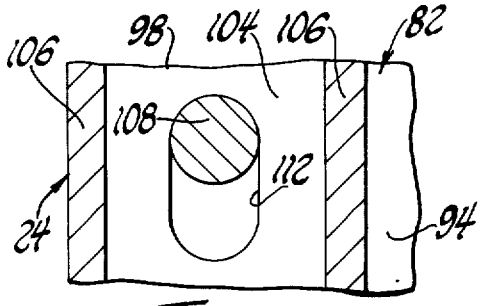
FIG. 6 is a sectional view of the seal taken along line 6—6 of FIG. 5.

With reference now to FIGS. 4 through 6, each of the longer and shorter seal members 98 and 100 shown in FIG. 4 has a configuration like the seal member 98 shown in the enlarged views of FIGS. 5 and 6 and is mounted on its associated diaphragm plate edge portion in the same manner. As can be seen, seal member 98 has a channel shape of an integral construction and includes a base 104 engaged with the edge portion 94 of the diaphragm plate on an inner side thereof which faces the oven with the door in its closed position of FIG. 7. Projection 106 of seal member 98 extend inwardly from the base 104 in a spaced relationship to each other and engage the furnace surface 80 at the periphery of the door opening in the manner shown by FIG. 7 to provide sealing of the door opening. A set of bolts 108, FIG. 4, is associated with each seal member 98 and 100 to provide mounting thereof on its associated diaphragm plate edge portion. A first set of holes 110 in each diagpragm plate edge portion 94 and 96 is aligned with a second set of oversized holes 112 in the base 104 of the associated seal member to receive the bolts 108 in the manner shown by FIG. 5 to provide mounting of the seal members. The heads of bolt 108 are located within the cross section of the seal member channel shapes such that their threaded ends extend through the associated diaphragm plate edge portion to receive a lock washer 114 and a cooperable nut 116 positioned on an outer plate side that faces outwardly toward the environment from the oven when the door is in the closed position of FIG. 7.

As seen by combined reference to FIGS. 4 and 6, the oversized holes 112 in the seal member bases 104 are elongated axially with respect to the elongated extent of the seal members extending toward the midsection of each seal member at normal environmental temperatures. During heating, the seal members expand axially and the oversized sets of holes 112 permit this expansion by allowing the seal members to slide relative to the diaphragm plate edge portions. The thermal expansion is due to differences in the heated conditions of the seal members 98 and 100 and their associated edge portions of the diaphragm plate 82. Of course, the longer seal members 98 expand considerably more than the shorter seal members 100 due to their relative lengths. Upper and lower ends 118 of the longer seal members 98 extend to the upper and lower extremities of the diaphragm plate while the shorter seal members 100 have ends 120 that terminate short of the lateral extremities of the diaphragm plate. The shorter seal member ends 120 engage the ends 118 of the longer seal members from the side so as not to interfere with thermal expansion of the longer seal members. During normal usage, the longer seal members 98 will expand on the order of ⅜ inch with respect to the side diaphragm plate edge portions 94 while the shorter seal members 100 will expand only about 1/10 of this amount. Consequently, the manner in which the seal members 98 and 100 are arranged on the diaphragm plate edge portions 94 and 96, respectively, with their ends engaged in the manner shown permits the longer seal members to expand for their full extent without interference while the shorter seal members can expand laterally without causing any considerably lateral deformation of the longer seal members.

Thermal expansion of the seal members 98 and 100 permitted by the manner in which these members are mounted on their associated diaphragm plate edge portions prevents the seal members from snaking in the plane of the diaphragm plate. However, the slidable mounting is really absolutely necessary only for the long seal members 98 due to the small amount of thermal expansion of the short seal members 100. Also, it should be noted that it is possible to have the oversized set of attachment bolt holes which permit the thermal expansion to be located in the diaphragm plate edge portions rather than in the seal members. However, it is preferable for the oversized set of holes to be in the seal members, as shown, such that the attachment bolts 108 will remain stationary during the seal member expansion. It has been found that this stationary bolt condition allows better sealing to be achieved.

The projections 106 of each seal member, as can be seen in FIG. 5, extend from the associated seal member base 104 a lesser distance than the width of the base in cross section. Due to their configurations, the seal members 98 and 100 are relatively flexible in a direction perpendicular to the plane of the diaphragm plate 82. Adjustment of the position of the diaphragm plate edge portions 94 and 96 inwardly and outwardly with respect to the oven is achieved by the use of adjusting screws 122 shown in FIG. 7. These adjusting screws 122 are spaced along the diaphragm plate edge portions at appropriate locations (every six inches or so) and are threadedly supported by lugs 124 fixed to the door structure in any suitable manner. Heads 126 of the adjusting screws permit axial screw movement inwardly and outwardly with respect to the oven and screw ends 128 engage the outer side of the diaphragm plate edge portions to provide inward and outward adjusting movement of the associated seal members. Adjustment at least as great as 2 inches is permitted due to the relatively flexible nature of the seal members and the manner in which the seal members are mounted on the diaphragm plate. Relatively abrupt irregularities in the furnace surface 80 at the periphery of the door opening 14 can thus be accommodated for due to the adjustment permitted by the seal 24 of this invention in order to ensure proper sealing.

During use of a coke oven door 12 having the seal 24 disclosed by the embodiment of FIGS. 1 through 7, tars and the like collect within the channel shapes of the seal members 98 and 100 and essentially fill the cross sections of the seal members after use for a predetermined period of time. This tar, etc. aids in the sealing function provided by the seal members in order to prevent gases from escaping from the oven.

Figure 8:
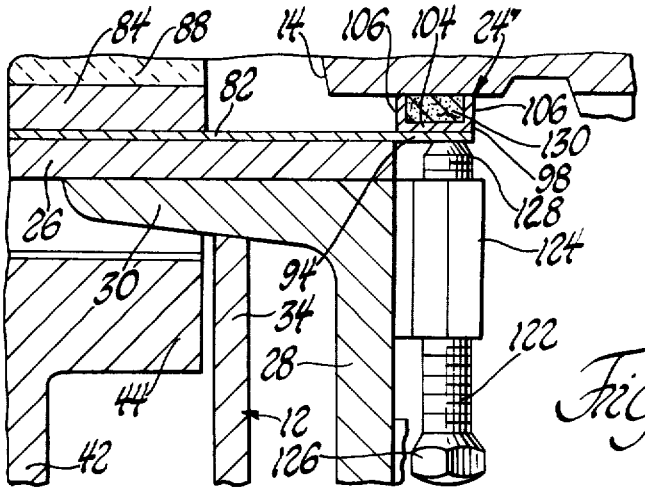
FIG. 8 is a view of another embodiment of the door seal taken in the same direction as FIG. 7.

In another embodiment of the seals 24' shown in FIG. 8, the cross section of each seal member receives high temperature sealing material 130 such as refractory rope. Adhesives and/or mechanical fasteners are used to secure the sealing material. Tars, etc. also collect about the sealing material within the seal member of this embodiment to aid in sealing the oven during use.

While preferred embodiments of the coke oven door seal have herein been described in detail, those skilled in the art will recognize various alternative designs and embodiments for practicing the present invention as defined by the following claims.

What is claimed is:

1. In an elongated rectangular coke oven door for closing a vertically extending door opening of a coke oven, a seal comprising: a metallic diaphragm plate of a vertically elongated rectangular shape secured to the door and including an inner side that faces toward the oven in a closed position of the door as well as an outer side that faces toward the environment in the door closed position; said diaphragm plate including relatively short upper and lower edge portions as well as relatively long side edge portions; each of said edge portions extending outwardly beyond the periphery of the door opening in the door closed position; elongated metallic seal members associated with the edge portions of the diaphragm plate and having long and short lengths corresponding to the lengths of the associated edge portions; each seal member having a channel shape including a base engaged with the associated edge portion of the diaphragm plate and a pair of spaced projections extending from the base; slidable connections mounting the bases of the long seal members on the side edge portions of the diaphragm plate at the inner side thereof so as to permit relative movement therebetween along the lengths of the seal members in a manner that accommodates for thermal expansion thereof with respect to the plate; the short seal members extending along the upper and lower edge portions of the plate having ends that terminate short of the side edge portions of the plate; the long seal members extending along the side edge portions of the plate having ends that extend into alignment with the short seal members so as to be engaged by the ends thereof from the side in a manner that seals therebetween without interfering with thermal expansion of the long seal members along the side edge portions of the plate; each of said seal members being relatively flexible in a direction perpendicular to the plane of the diaphragm plate; the projections of the seal members engaging the oven about the periphery of the door opening in the door closed position to provide sealing thereof; and means for adjusting the position of the diaphragm plate edge portions inward and outward with respect to the oven along the lengths thereof so as to flex the seal members to ensure engagement of the seal members with the oven in the door closed position and consequent sealing of the door opening.

2. A seal as in cliam 1 wherein the slidable connections for the long seal members include a plurality of attachment bolts, a first set of holes through which the bolts extend in the side edge portions of the diaphragm plate, and a second set of holes through which the bolts extend in the bases of the long seal members extending along the side edge portions of the plate, one of said sets of holes being oversized to permit the long seal members along the side edge portions of the plate to thermally expand along their lengths with respect to the plate.

3. A seal as in claim 2 wherein the long seal members mounted on the side edge portions of the plate include the oversized set of holes such that the bolts do not move during expansion of the long seal members along the side edge portions of the plate.

4. A seal as in claim 1 where the base and projections of each seal member are of an integral construction.

5. A seal as in claim 1 wherein the seal members include high temperature sealing material received within the channel shapes thereof.

6. A seal as in claim 1 wherein the diaphragm plate and the channel-shaped seal members are made from stainless steel.

7. A seal as in claim 1 wherein the projections of each seal member project from their base for a lesser distance than the width of the base in cross section.

8. A seal as in claim 1 wherein the adjusting means includes adjusting screws threadedly supported on the door at spaced locations along the edge portions of the plate and including ends that engage the outer side of the plate to move the plate and seal members with respect to the oven so that the projections of the seal members engage the oven about the complete periphery of the door opening thereof to provide complete sealing.

9. In an elongated rectangular coke oven door for closing a vertically extending door opening of a coke oven, a seal comprising: a metallic diaphragm plate of a vertically elongated rectangular shape secured to the door and including an inner side that faces toward the oven in a closed position of the door as well as an outer side that faces toward the environment in the door closed position; said diaphragm plate including relatively short upper and lower edge portions as well as relatively long side edge portions; each of said edge portions extending outwardly beyond the periphery of the door opening in the door closed position; elongated steel seal members respectively associated with the edge portions of the plate and having long and short lengths corresponding to the lengths of the associated edge portions; each seal member having a base and a pair of integral projections extending from the base with a channel shape; a first set of holes spaced along the side edge portions of the diaphragm plate; a second set of holes spaced along the bases of the long seal members in alignment with the set of holes in the diaphragm plate edge portions; a set of attachment bolts extending through the aligned holes of the long seal members and the diaphragm plate edge portions to mount the long seal members on the plate with the bases thereof engaging the inner plate side and with the projections thereof engaging the oven about the periphery of the door opening in the door closed position to provide sealing thereof; one of said sets of holes associated with the side edge portions of the plate and the long side members being oversized to permit thermal expansion of the mounted long seal members with respect to the side edge portions of the diaphragm plate; means mounting the short seal members on the upper and lower edge portions of the plate with their bases engaging the inner side of the plate and with their projections engaging the oven in the door closed position; the short seal members extending along the upper and lower edge portions of the plate having ends that terminate short of the side edge portions of the plate; the long seal members extending along the side edge portions of the plate having ends that extend into alignment with the short seal members so as to be engaged by the ends thereof from the side in a manner that seals therebetween without interfering with thermal expansion of the long seal members along the side edge portions of the plate; the mounted seal members being relatively flexible in a direction perpendicular to the plane of the diaphragm plate due to their channel shapes; and means for adjusting the position of the diagpragm plate edge portions inward and outward with respect to the oven along the lengths thereof so as to flex the seal members and thereby ensure engagement of the seal member projections with the oven in the door closed position and consequent sealing of the door opening.

10. In an elongated rectangular coke oven door for closing a vertically extending door opening of a coke oven, a seal comprising: a steel diaphragm plate of a vertically elongated rectangular shape secured to the door and including an inner side that faces toward the oven in a closed position of the door as well as an outer side that faces toward the environment in the door closed position; said diaphragm plate including relatively short upper and lower edge portions as well as relatively long side edge portions extending outwardly beyond the periphery of the door opening in the door closed position; elongated metallic seal members associated with the edge portions of the diaphragm plate and having long and short lengths corresponding to the lengths of the associated edge portions; each seal member having a channel shape including a base and a pair of integral projections extending from the base; a first set of holes spaced along the side edge portions of the diaphragm plate; a second set of oversized holes spaced along the bases of the long seal members in alignment with the set of holes in the diaphragm plate edge portions; a set of attachment bolts extending through the aligned holes of the long seal members and the diaphragm plate side edge portions to mount the long seal members on the plate with the bases thereof engaging the inner plate side and with the projections thereof engaging the oven about the periphery of the door opening in the door closed position to provide sealing thereof; the set of oversized holes in the long seal members permitting thermal expansion thereof with respect to the diaphragm plate while the bolts remain stationary; said short seal members including opposite ends that terminate short of the side edge portions of the plate; the long seal members extending along the side edge portions of the plate having ends that extend into alignment with the short seal members so as to be engaged by the ends thereof from the side in a manner that seals therebetween without interfering with thermal expansion of the long seal members along the side edge portions of the plate; the mounted seal members being relatively flexible in a direction perpendicular to the plane of the diaphragm plate due to their channel shapes; and adjusting screws threadedly supported on the door in a spaced relationship along the diaphragm plate edge portions and including ends that engage the outer side of the plate edge portions to adjust the position thereof inward and outward with respect to the oven along the lengths thereof so as to flex the seal members and thereby ensure engagement thereof with the oven in the door closed position and consequent sealing of the door opening.

11. A seal for an edge portion of a coke oven door diaphragm plate, the seal comprising: an elongated steel seal member having a channel shape including a base and a pair of integral projections extending from the base; the projections of the seal member extending from the base thereof for a lesser distance than the width of the base in cross section; a set of holes in the base of the seal member for receiving attachment bolts to mount the seal member on an edge portion of a coke oven door diaphragm plate; and the set of holes being oversized along the length of the seal member so as to permit thermal expansion of the seal member with respect to the diaphragm plate.

12. A seal as in claim 11 wherein the seal member is made of stainless steel.

* * * * *